US005138724A

United States Patent [19]

Chien et al.

[11] Patent Number: 5,138,724

[45] Date of Patent: Aug. 18, 1992

[54] DELAYED AUTO-RISING TOILET SEAT

[76] Inventors: Fong N. Chien, No. 294, Ching Cheng Rd., Taichung; Chun L. Ou, No. 700, Sec. 1, Chung Chi Rd., Wu Chi Chen, Taichung Hsien, both of Taiwan

[21] Appl. No.: 676,858

[22] Filed: Mar. 28, 1991

[51] Int. Cl.[5] ..... A47K 13/10

[52] U.S. Cl. ..... 4/241; 4/237; 4/246.2

[58] Field of Search ..... 4/234, 237, 241, 248, 4/249, 250, 251

[56] References Cited

U.S. PATENT DOCUMENTS

| | | | |
|---|---|---|---|
| 1,386,196 | 8/1921 | Munn | 4/251 |
| 2,214,323 | 9/1940 | Carter | 4/251 |
| 2,236,466 | 3/1941 | Cashwell | 4/251 |
| 2,772,422 | 12/1956 | Knudsen | 4/251 |
| 4,910,810 | 3/1990 | Solomon | 4/251 |

FOREIGN PATENT DOCUMENTS

| | | | |
|---|---|---|---|
| 145602 | 3/1952 | Australia | 4/251 |
| 2631053 | 11/1989 | France | 4/241 |

*Primary Examiner*—Charles E. Phillips

*Attorney, Agent, or Firm*—Poms, Smith, Lande & Rose

[57] ABSTRACT

An apparatus has a housing being attached on a rear portion of a toilet seat which is pivotally mounted to a toilet bowl. The housing has a front portion deposited in front of a pivot axis of the toilet seat and an upper and lower chamber deposited behind the pivot axis. The front portion and the upper and lower chambers communicating with each other to allow liquid to flow therein to delay and actuate a rising movement of the toilet seat.

5 Claims, 6 Drawing Sheets

DELAYED AUTO-RISING TOILET SEAT

BACKGROUND OF THE INVENTION

This invention relates to an apparatus for automatically raising a toilet seat, and more particularly, to a toilet seat having a period of time before being raised automatically.

There are many types of toilet seats available on the commerical market which have a feature of being raised automatically. Most of those toilet seats are operated substantially under the lever principle; thus, many components, such as a block weight, connecting rod, line, etc., are necessary, forming a complicated combination to achieve an auto-rising performance. Alternately, an auto-rising toilet seat may employ a complicated gear mechanism cooperating with an electric motor to perform the same function.

It is noted that all toilet seat mentioned above are composed of many components, some of them being delicate; thus, it is disadvantageous either in manufacturing or in installation and also very expensive.

Further, a rising performance of most toilet seats is in a continuous reaction, i.e., the toilet seat is pushed down by a pressure, and when the external pressure is released, the toilet seat rises immediately. That is very inconvenient for a user since he has to depress the toilet seat and keep it in a horizontal position with hand before he sits down and as he stands up.

Therefore, a simple, cheap, and highly effective apparatus for raising toilet seat automatically with a period of delayed time is requested to improving drawback mentioned above.

SUMMARY OF THE INVENTION

This invention provides an apparatus which has a housing containing liquid therein. A toilet seat is pivotally mounted on a toilet bowl. The housing of the apparatus is attached on a rear portion of the toilet seat, crosses a pivot axis of the seat, and is substantially divided into three intercommunicated chambers. A first retaining chamber is deposited in front of the pivot axis, and a second upper and a third lower counterweighing chambers are located behind the pivot axis.

When the toilet seat is in a normal upright condition the liquid in the housing is concentrated in the second upper chamber, which is in a position below a plane along the pivot axis. When the toilet seat is pressed down, the liquid flows into the front retaining chamber to keep the toilet seat in a horizontal position by weight thereof. While the toilet seat is in use, the liquid drops into the third lower chamber, so that as the user stands up the toilet seat is risen up by a moment produced by weight of the water.

Therefore, it is a primary object of this invention to provide an apparatus for raising a toilet seat with a delayed rise time.

It is further an object of this invention to provide an apparatus which utilizes liquid to keep the toilet seat in a horizontal position.

It is another object of this invention to provide an apparatus for raising the toilet seat with a delayed rise time which is capable of being molded in a single piece with the toilet seat.

Yet a further object of this invention is to provide an apparatus with a simple construction and few components to perform a rising movement of a toilet seat.

These and other objects will be apparent for those skilled in this art from a non-limitative example embodying the present invention described below, wherein the apparatus according to this invention is modeled in a piece with a toilet seat for a convenient illustration.

DETAILED DESCRIPTION OF THE PREFERRED EMBODIMENT

Figure 1:
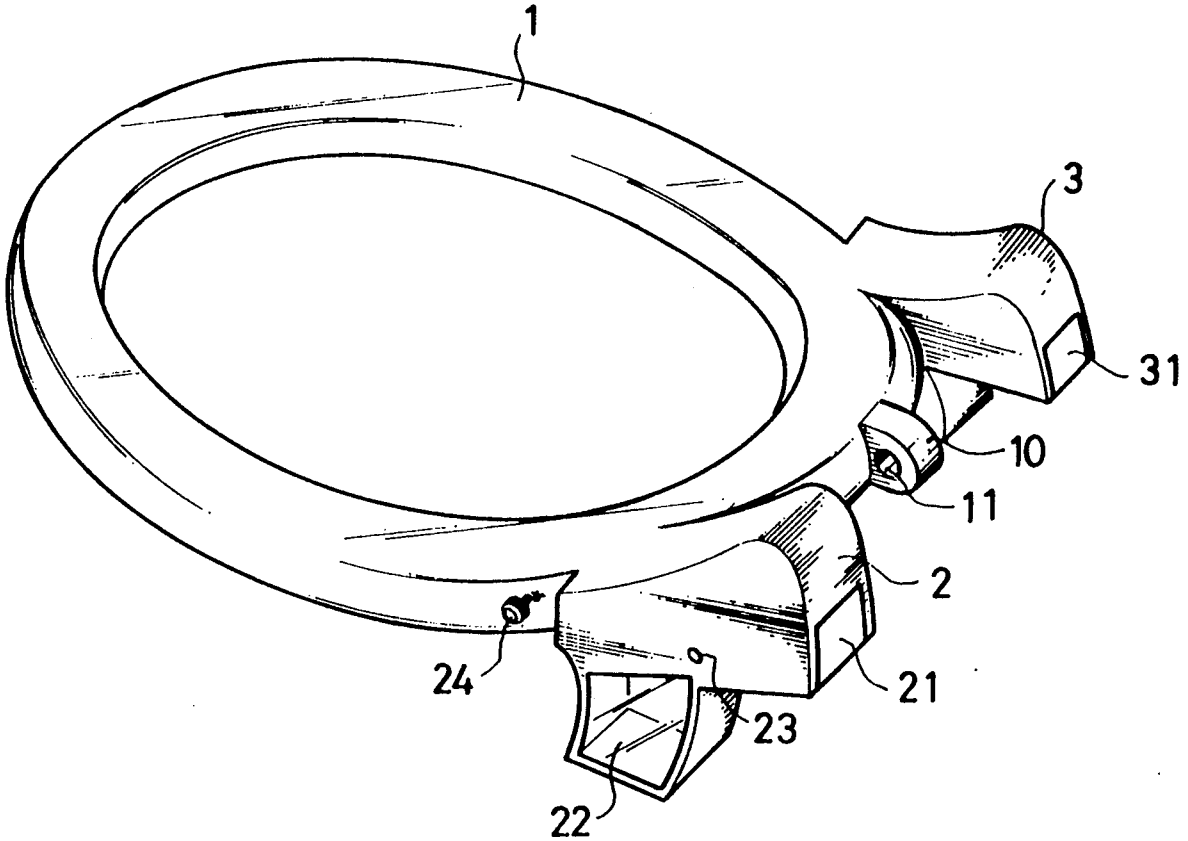
FIG. 1 is a perspective view of a toilet seat with an apparatus according to this invention.

Referring to FIG. 1, a toilet seat 1 with identical delaying apparatuses 2 and 3 according to this invention can be seen. The toilet seat 1 has a pair of protruding fixing plates 10 formed on a rear portion thereof, each plate 10 having a fixing hole 11 therein, to be pivotally fixed onto a toilet bowl (not shown). The apparatuses 2 and 3 are integrally attached on each side of the toilet seat, respectively. The following description merely illustrates only apparatus 2 for convenience, while the description for apparatus 3 is the same.

Figure 2:
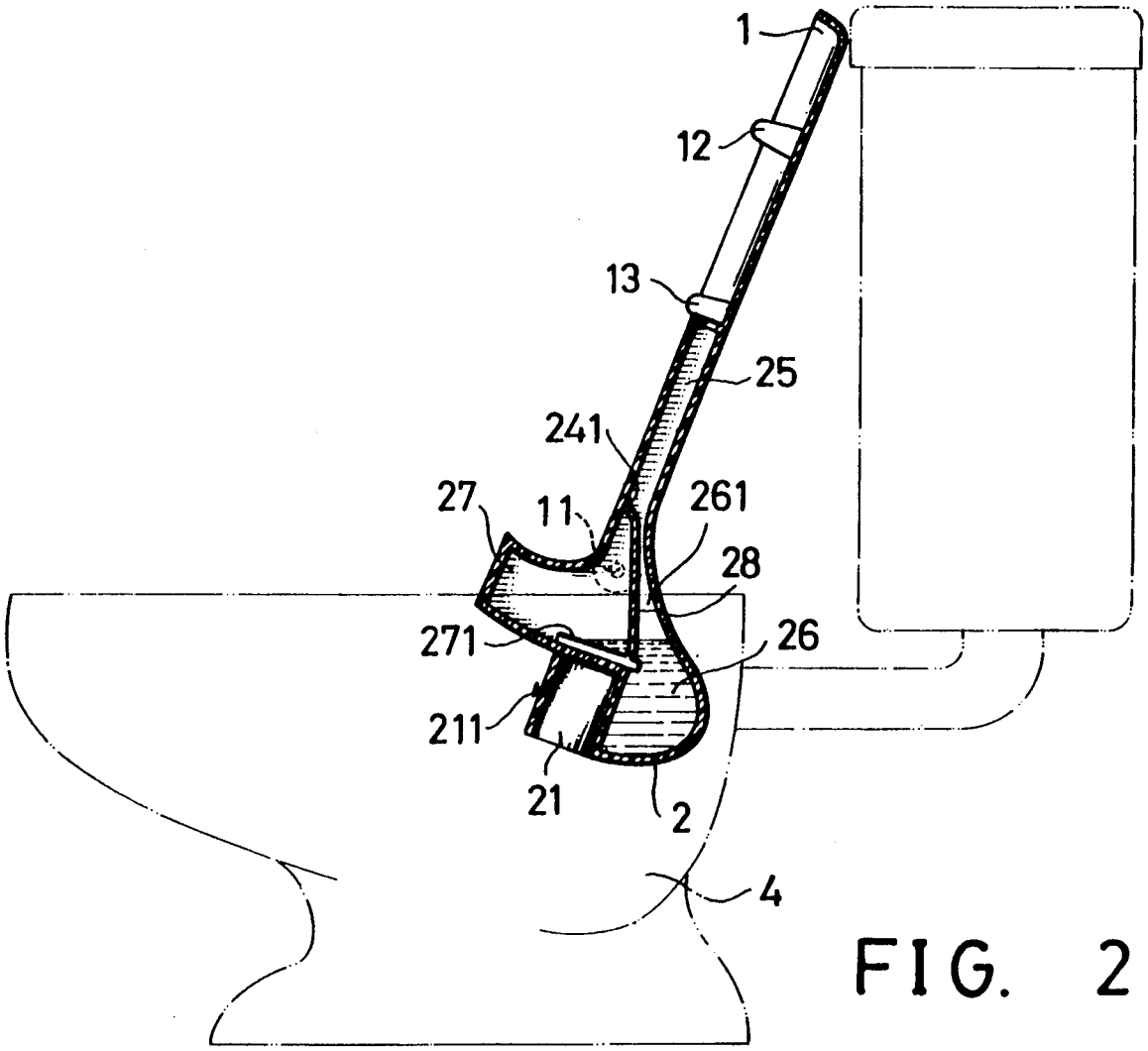
FIG. 2 is a partial cross-sectional view of a toilet seat, wherein the toilet seat according to this invention is in an vertical position.

The apparatus 2 is a housing and, additionally referring to FIG. 2, is substantially divided into three chambers by a division plate 28. In a direction along an upper plane of the toilet seat 1, a first chamber 25 of the apparatus 2 is formed in the toilet seat 1 in front of a pivot axis thereof which extends through fixing holes 11 in fixing plates 10, while a second chamber 26 and a third chamber 27 are both formed in an opposite direction from the first chamber 25, i.e., behind the pivot axis. It is noted that the second chamber 26 is positioned above a horizontal plane along the pivot axis when the toilet seat 1 is in a horizontal condition, and the third chamber 27 is positioned below the horizontal plane and located between the pivot axis and the second chamber 26.

The chambers 25, 26, and 27 intercommunicated with each other; the second chamber 26 communicates with the first chamber 25 by a passage 261; the first chamber 25 communicates with the third chamber 27 through an orifice 241 formed on the division plate 28; and the third chamber 27 communicates with the second chamber 26 by a conduit pipe 271. It is noted that a cross section of the passage 261 is substantially larger than that of the conduit pipe 271.

The second chamber 26 has an intake port 23 on a lateral surface thereof for an injection of liquid. The second chamber 27 provides a window 22 on a lateral outside surface thereof. Thus, liquid is capable of being observed from the window 22 as it flows into the chamber 26 through the intake port 23. The housing 2 further provides a recess formed on a rear wall of the chamber 26 so as to receive a block weight 21. The recess has a screw 211 in a bottom thereof, as especially shown in FIG. 2, to adjustably fix the block weight 21 in the recess.

Furthermore, the housing 2 has throttling screw 24 located on a rear portion thereof, between the first chamber 25 and the third chamber 27, to control a width of the orifice 241, thereby defining a flow rate of the liquid from the first chamber 26 to the third chamber 27, determining a length of a delay time for a rising movement of the toilet seat 1.

Figure 3:
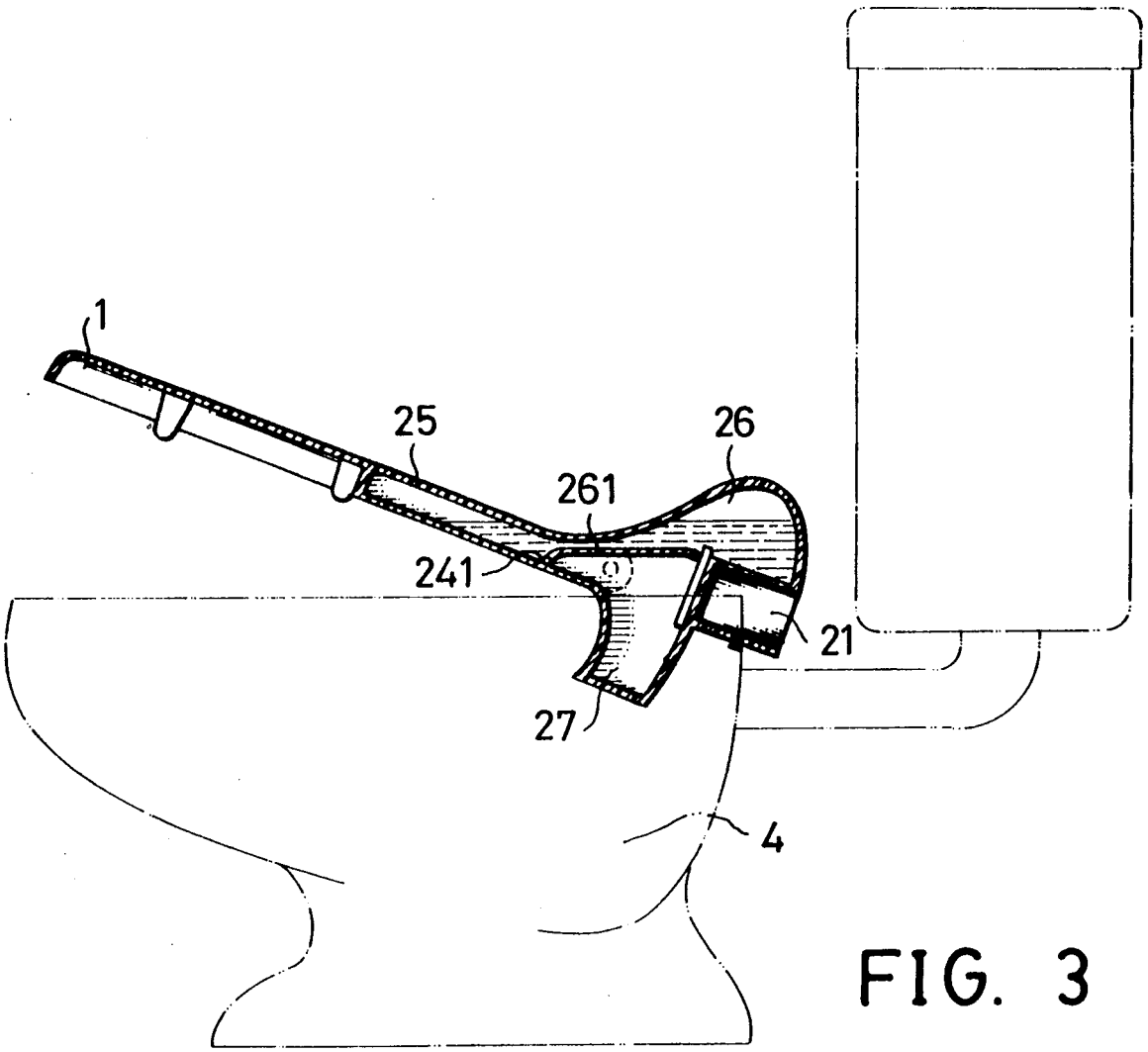
FIG. 3 is a view similar to FIG. 2 but with the toilet seat in a tilted condition.
Figure 4:
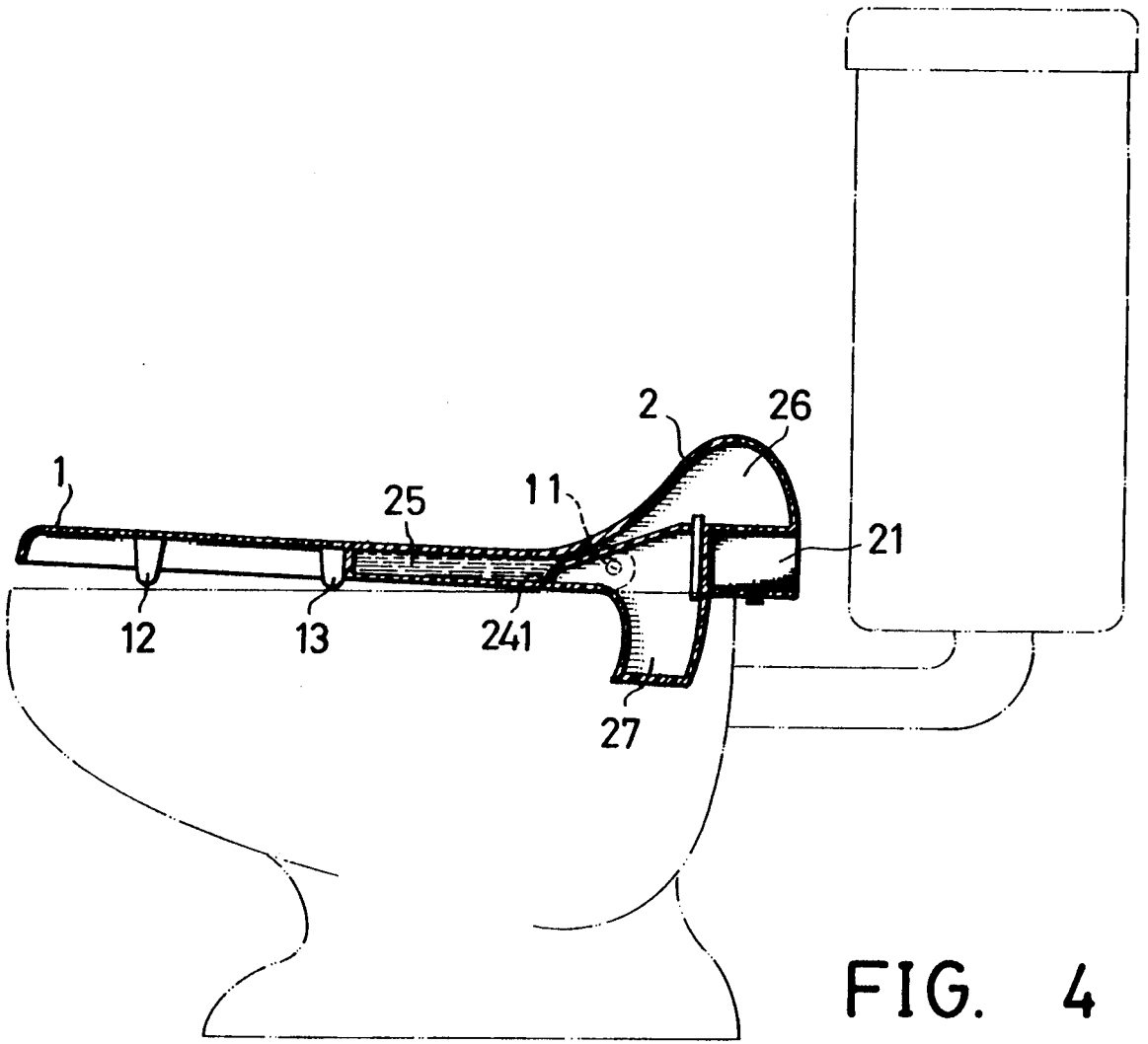
FIG. 4 is a view similar to FIG. 2, wherein the toilet seat is in a horizontal position.

Under normal conditions the toilet seat 1 is in an upward direction as shown in FIG. 2. The liquid contained in the second chamber 26 is concentrated in a rear portion thereof by gravity. When the toilet seat is pressed down, as shown in FIG. 3, the liquid contained within the second chamber 26 flows on top of the division plate 28, through the passage 261, into the first chamber 25. Referring to FIG. 4, when the toilet seat 1 reaches a horizontal position, since the position of the second chamber 26 is higher than that of the first chamber 25, the liquid completely flows into the first chamber 25. By the weight of the liquid, the toilet seat 1 is kept in that position, i.e., a horizontal position, and does not rise immediately, even though there is a block weight 21, which is adjustable, in a rear portion of the housing 2. Therefore, the purpose of this invention is achieved.

Figure 5:
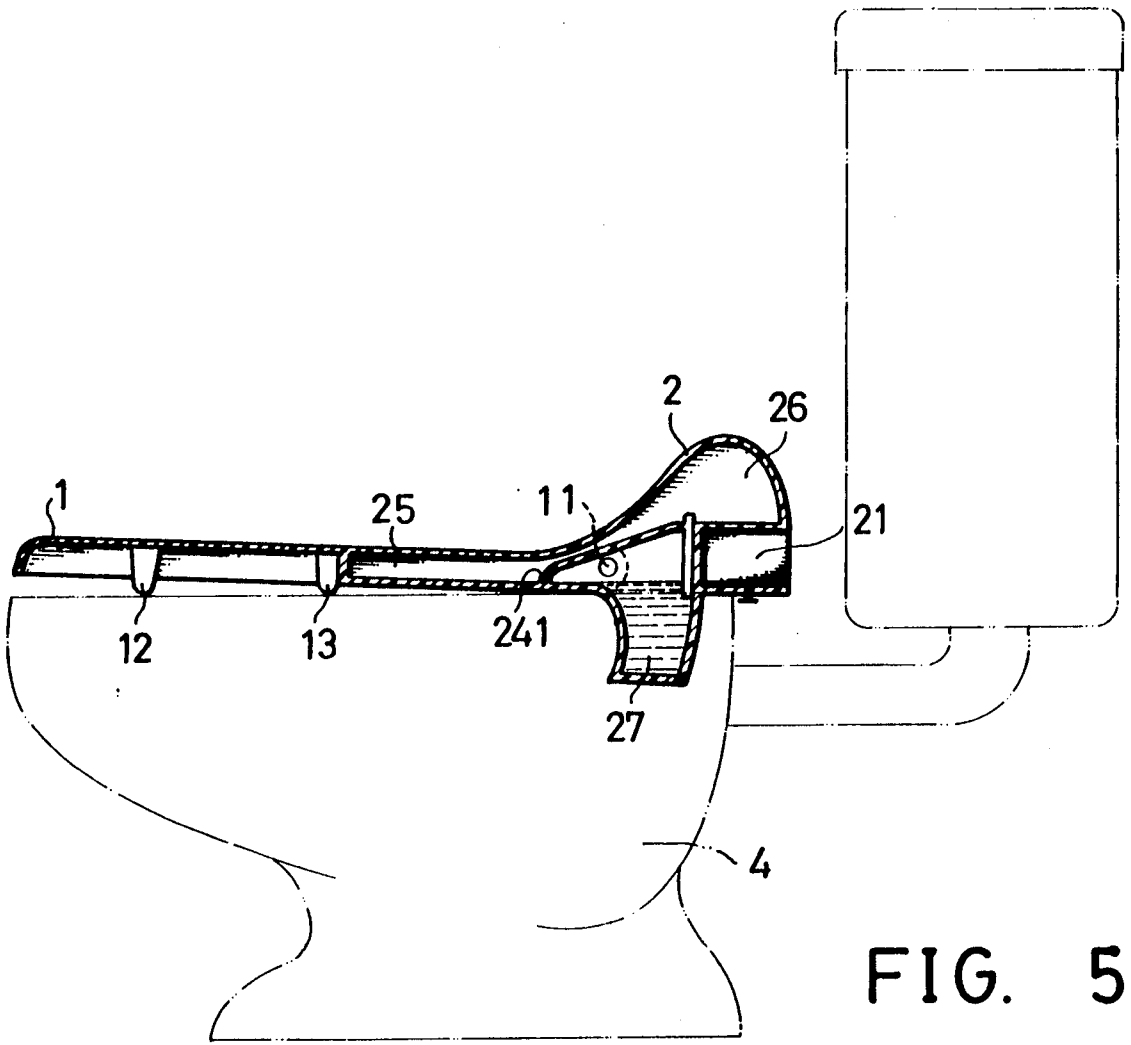
FIG. 5 is a view similar to FIG. 4, wherein liquid in the apparatus has flowed into a lower chamber.

Referring to FIG. 5, during use of the toilet seat 1, the liquid in the first chamber 25 flows through the orifice 241 into the third chamber 27, being deposited below the horizontal plane of the first chamber 25. Moreover, the toilet seat 1 according to the present invention has a pair of projections 12 and 13 of different heights fixed in a front portion thereof to define a slightly sloped plane to facilitate the flow of the liquid. When a user sits on the toilet seat 1, stands up, and leaves, the pressure is released, thus the toilet seat 1 pivotally rises, in a direction of the arrow, about the pivot axis through the fixing holes 11; that is, the toilet seat 1 actuated by a moment produced by the liquid contained in the third chamber 27 and the block weight 21.

Figure 6:
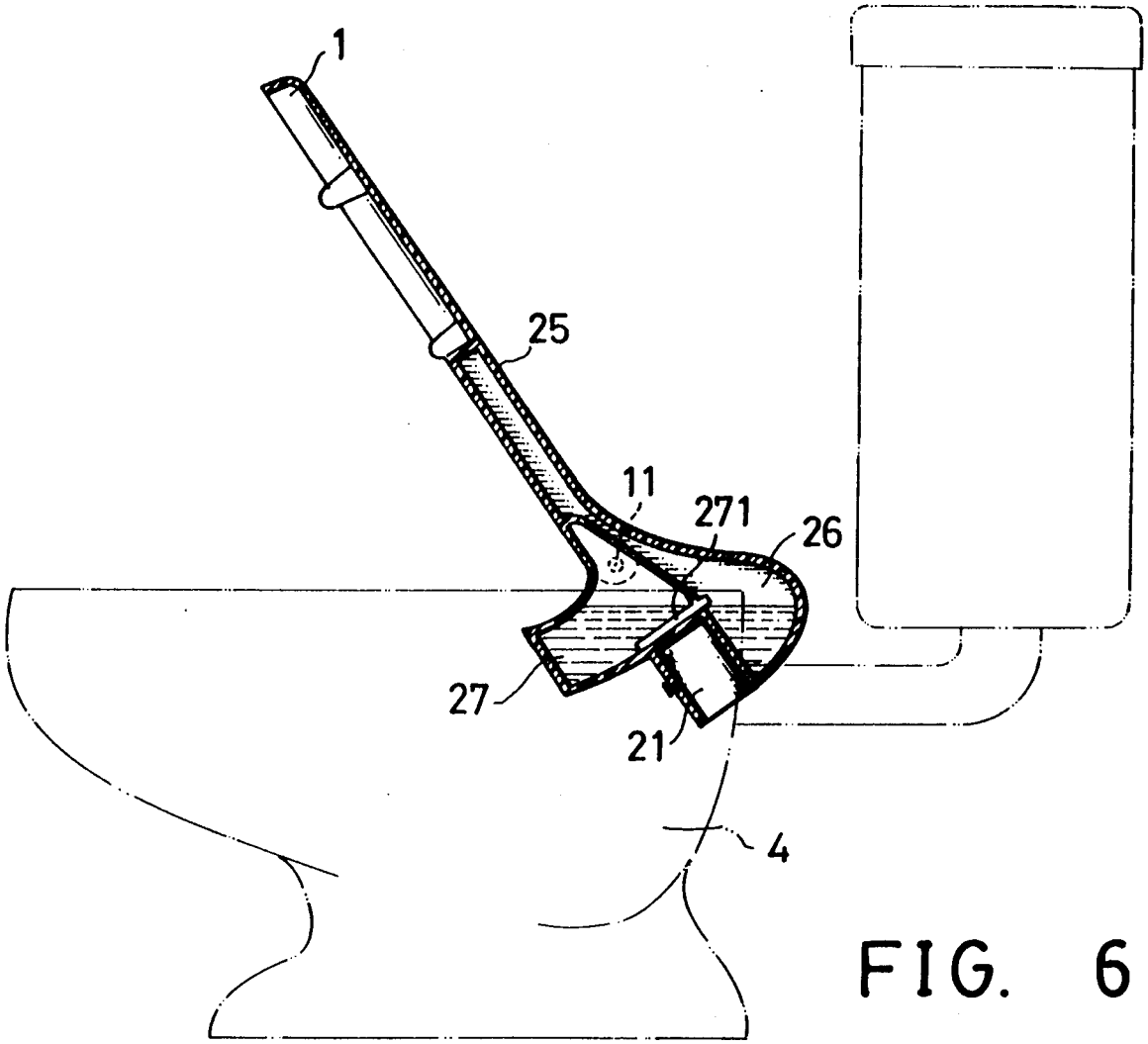
FIG. 6 is a view similar to FIG. 3, wherein the toilet seat is in a rising condition.

When the toilet seat 1 is pivoting to an upright position, referring to FIG. 6, the liquid in the third chamber 27 flows into the second chamber 26 through the conduit pipe 271. That results in a continuous rotation of the toilet seat 1 until the toilet seat 1 abuts a water tank of the toilet, and thus the toilet seat 1 is kept in an upward direction such as shown in FIG. 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. An apparatus for delaying a rising movement of a toilet seat from a generally horizontal use position to a generally vertical non-use position, comprising a housing containing a liquid therein, said housing being attached on a rear portion of said toilet seat such that a portion of said housing lies on each side of a pivot axis of said seat, said housing comprising a front portion deposited in front of the pivot axis, and a rear portion communicating with said front portion via an orifice, said rear portion being deposited behind said pivot axis when said seat is in said horizontal position, wherein the liquid in said housing is of such a quantity as to fill only one of said front and rear portions at a time, when said seat is manually placed in said horizontal position said liquid will occupy said front portion and counter balance said seat to said horizontal position until such time as said liquid has moved via said orifice to said rear housing at which time said seat will be urged toward said vertical position.

2. A delaying apparatus as claimed in claim 1, wherein said rear portion of said housing further comprises an upper chamber and a lower chamber communicating with said upper chamber, said upper and lower chambers communicating with said front portion, respectively.

3. A delaying apparatus as claimed in claim 1, wherein an adjusting means is arranged between said front portion and said lower chamber for controlling a flow rate of the liquid.

4. A delaying apparatus as claimed in claim 1, wherein said rear portion further comprises a recess for receiving a block weight.

5. A toilet seat as claimed in claim 1, wherein said toilet seat is integrally molded with said housing in a single piece.

* * * * *